US010726816B2

(12) United States Patent
Mueller

(10) Patent No.: US 10,726,816 B2
(45) Date of Patent: Jul. 28, 2020

(54) SENSOR AND CONTROLLER FOR WIND INSTRUMENTS

(71) Applicant: Matthias Mueller, Zurich (CH)

(72) Inventor: Matthias Mueller, Zurich (CH)

( * ) Notice: Subject to any disclaimer, the term of this patent is extended or adjusted under 35 U.S.C. 154(b) by 0 days.

(21) Appl. No.: 16/514,698

(22) Filed: Jul. 17, 2019

(65) Prior Publication Data

US 2019/0341008 A1 Nov. 7, 2019

Related U.S. Application Data

(63) Continuation of application No. 15/819,803, filed on Nov. 21, 2017, now Pat. No. 10,403,247.

(60) Provisional application No. 62/576,944, filed on Oct. 25, 2017.

(51) Int. Cl.

| | |
|---|---|
| ***G10D 7/06*** | (2020.01) |
| ***G10D 9/00*** | (2020.01) |
| ***G10H 1/00*** | (2006.01) |

(52) U.S. Cl.

CPC ..... *G10D 7/06* (2013.01); *G10D 9/00* (2013.01); *G10H 1/0008* (2013.01); *G10H 2220/201* (2013.01); *G10H 2220/361* (2013.01); *G10H 2220/391* (2013.01); *G10H 2220/395* (2013.01); *G10H 2220/411* (2013.01)

(58) Field of Classification Search

CPC ..... G10D 7/06; G10D 9/00; G10H 1/0008; G10H 2220/201; G10H 2220/361; G10H 2220/391; G10H 2220/395; G10H 2220/411

USPC ..... 84/453

See application file for complete search history.

(56) References Cited

U.S. PATENT DOCUMENTS

| | | | | |
|---|---|---|---|---|
| 5,286,913 | A * | 2/1994 | Higashi | G10H 1/055 84/622 |
| 5,525,142 | A * | 6/1996 | Yamauchi | G10H 1/0008 84/477 R |
| 6,538,189 | B1 * | 3/2003 | Ethington | G10H 1/34 84/615 |
| 6,689,947 | B2 * | 2/2004 | Ludwig | G10H 1/00 84/645 |
| 7,309,829 | B1 * | 12/2007 | Ludwig | G10H 1/00 84/609 |
| 7,554,028 | B2 * | 6/2009 | Fujii | G10H 1/0008 84/723 |
| 10,403,247 | B2 * | 9/2019 | Mueller | G10D 7/06 |
| 2002/0005108 | A1 * | 1/2002 | Ludwig | G10H 1/00 84/600 |
| 2002/0005111 | A1 * | 1/2002 | Ludwig | G10H 1/00 84/645 |
| 2003/0196542 | A1 * | 10/2003 | Harrison, Jr. | G04B 25/00 84/737 |

(Continued)

FOREIGN PATENT DOCUMENTS

WO WO-2012098278 A1 * 7/2012 ..... G10H 1/0066

*Primary Examiner* — David S Warren
*Assistant Examiner* — Christina M Schreiber
(74) *Attorney, Agent, or Firm* — Ted Sabety; Sabety + associates, PLLC

(57) ABSTRACT

This invention involves the field of tactile control of electronic devices using a sensor that transduces both air pressure and device positional orientation into a set of digitally encoded commands. The invention involves using as input the physical action taken on a musical instrument and generating control information using that input.

19 Claims, 5 Drawing Sheets

(56) References Cited

U.S. PATENT DOCUMENTS

| | | | | |
|---|---|---|---|---|
| 2004/0069129 | A1* | 4/2004 | Ludwig | G10H 1/00 84/645 |
| 2005/0120870 | A1* | 6/2005 | Ludwig | G10H 1/00 84/661 |
| 2005/0217464 | A1* | 10/2005 | Onozawa | G10H 1/055 84/723 |
| 2007/0017352 | A1* | 1/2007 | Masuda | G10H 1/053 84/658 |
| 2007/0144336 | A1* | 6/2007 | Fujii | G10H 3/24 84/723 |
| 2007/0169615 | A1* | 7/2007 | Chidlaw | G10H 1/0091 84/723 |
| 2007/0261540 | A1* | 11/2007 | Gremo | G10H 1/344 84/743 |
| 2008/0017014 | A1* | 1/2008 | Suzuki | G10C 3/00 84/385 R |
| 2009/0020000 | A1* | 1/2009 | Onozawa | G10D 7/00 84/723 |
| 2009/0114079 | A1* | 5/2009 | Egan | G09B 15/023 84/477 R |
| 2011/0143837 | A1* | 6/2011 | Riopelle | G10H 1/00 463/35 |
| 2014/0251116 | A1* | 9/2014 | Peterson | G10H 1/0008 84/645 |
| 2015/0101477 | A1* | 4/2015 | Park | G10H 1/18 84/633 |
| 2018/0137846 | A1* | 5/2018 | Pouillard | G10H 1/32 |
| 2018/0268791 | A1* | 9/2018 | Okuda | G10H 1/0008 |
| 2019/0019485 | A1* | 1/2019 | Toyama | G10H 1/0008 |
| 2019/0122644 | A1* | 4/2019 | Mueller | G10D 9/00 |
| 2019/0156806 | A1* | 5/2019 | Maezawa | G10H 1/0008 |
| 2019/0341008 | A1* | 11/2019 | Mueller | G10D 7/06 |

* cited by examiner

SENSOR AND CONTROLLER FOR WIND INSTRUMENTS

PRIORITY

This application claims priority as a continuation of U.S. patent application Ser. No. 15,819,803, filed on Nov. 21, 2017, which is a non-provisional continuation of U.S. patent application Ser. No. 62/576,944 filed on Oct. 25, 2017, all of which are hereby incorporated by reference in their entireties for all that they teach.

FIELD OF INVENTION

This invention involves the field of tactile control of electronic devices using a sensor that transduces both air pressure and device positional orientation into a set of digitally encoded commands. The invention involves using as input the physical action taken on a musical instrument and generating control information using that input.

BACKGROUND

In the past, musical instruments have been used to record audio signals into recording devices. However, a musical instrument involves more than just notes. Playing a wind instrument, like clarinet, involves using air pressure, delivered by the musician's mouth, into the mouthpiece, where a reed resonates. When a musician seeks to play louder, say during a crescendo, the musician blows harder into the instrument. In a wind instrument, the air pressure in the mouth is increased as a result. In addition, musician's express themselves through movement of the instrument while playing. While playing, the musician may move the distal end of the instrument up and down, or from side to side. The air pressure and movement of the instrument can be utilized as additional forms of instrumental control by use of the invention. This is accomplished by using sensors that detect these changes, convert these changes into encoded data and then use this encoded data to generate other controller commands ranging from modifications of an audio signal to controlling stage lighting.

DETAILED DESCRIPTION

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other features not described in detail herein. Additionally, some well-known structures or functions may not be shown or described in detail below, so as to avoid unnecessarily obscuring the relevant description. The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

Figure 1:
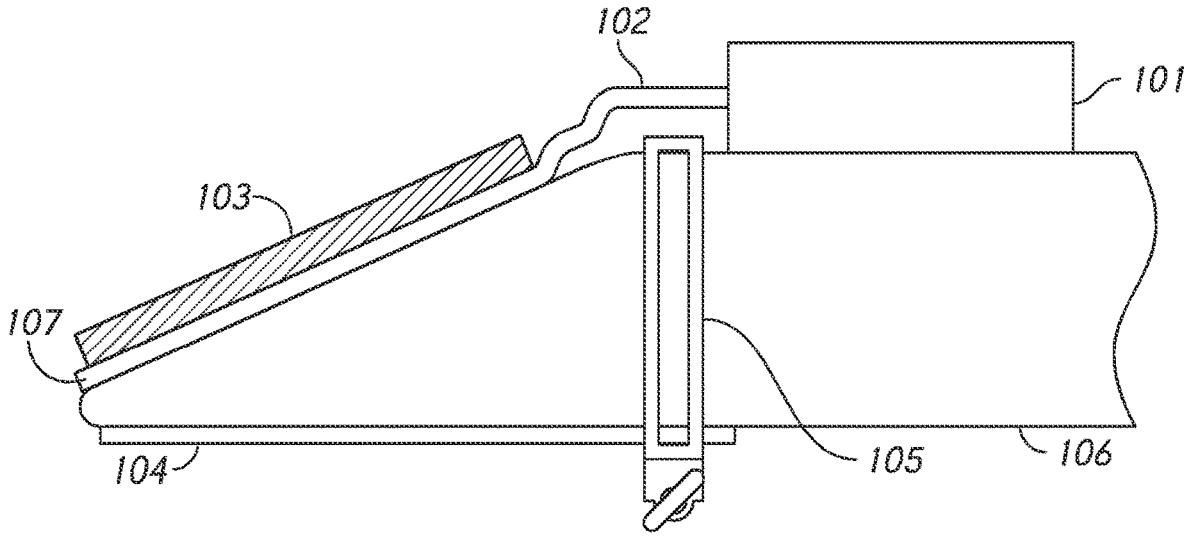
FIG. 1 shows a side view of the SMS Sensor module of the invention attached to a wind instrument mouthpiece
Figure 2:
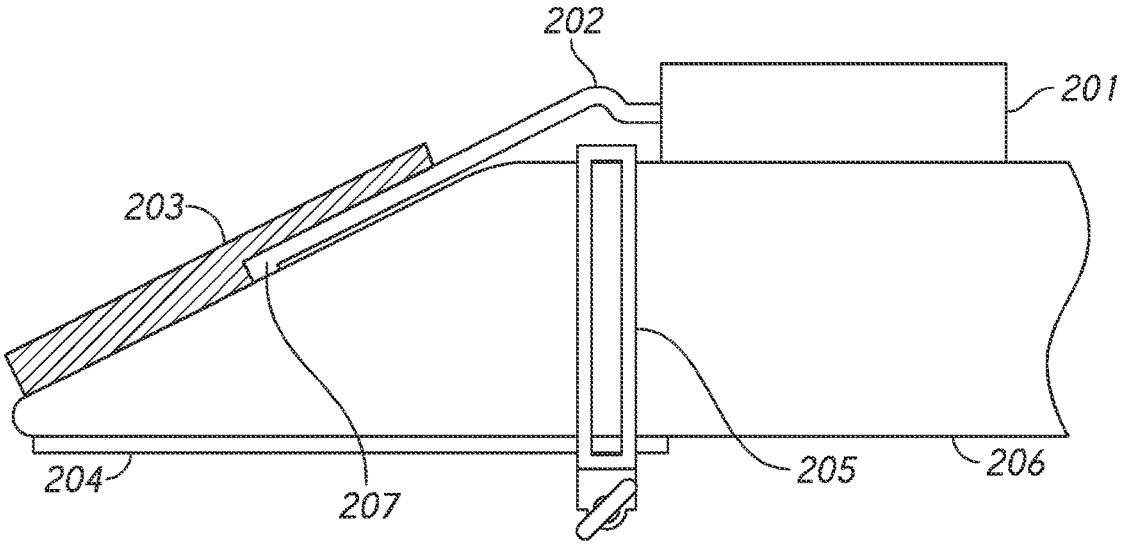
FIG. 2 shows a side view of the SMS Sensor module of the invention attached to the mouthpiece of a wind instrument
Figure 3:
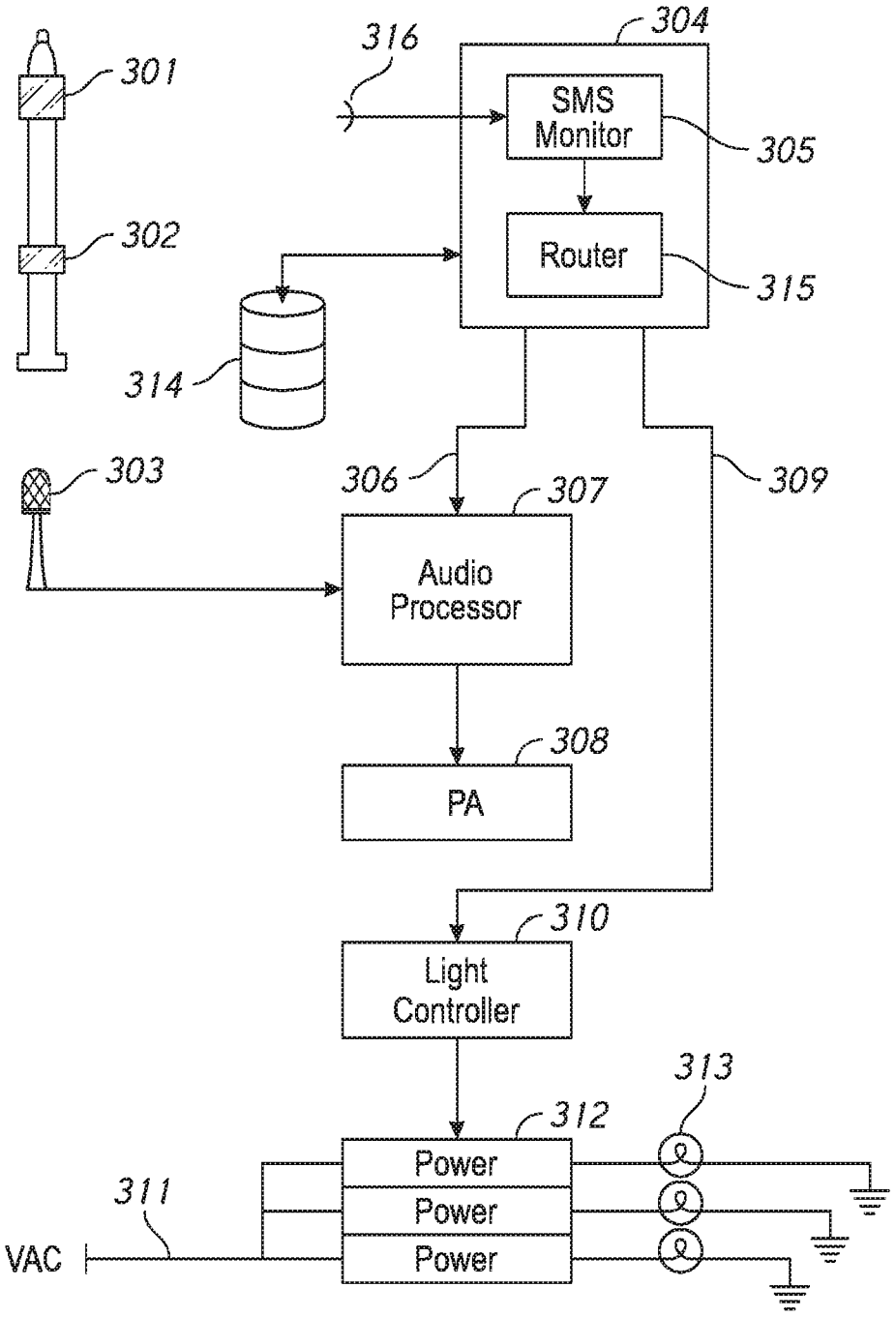
FIG. 3 shows the basic system architecture
Figure 4:
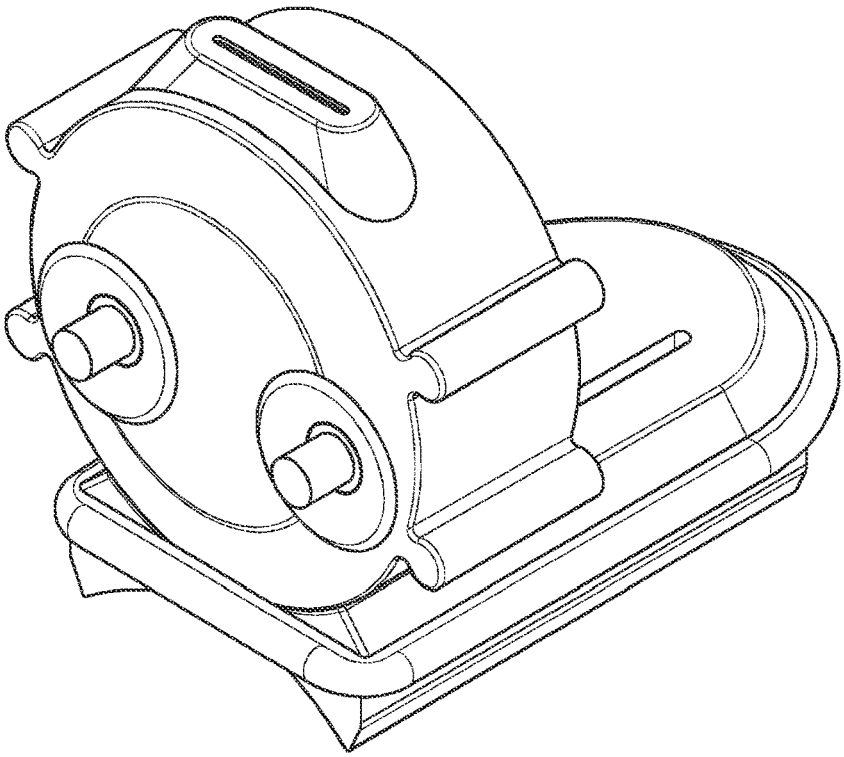
FIG. 4 shows the SMS sensor housing
Figure 5:
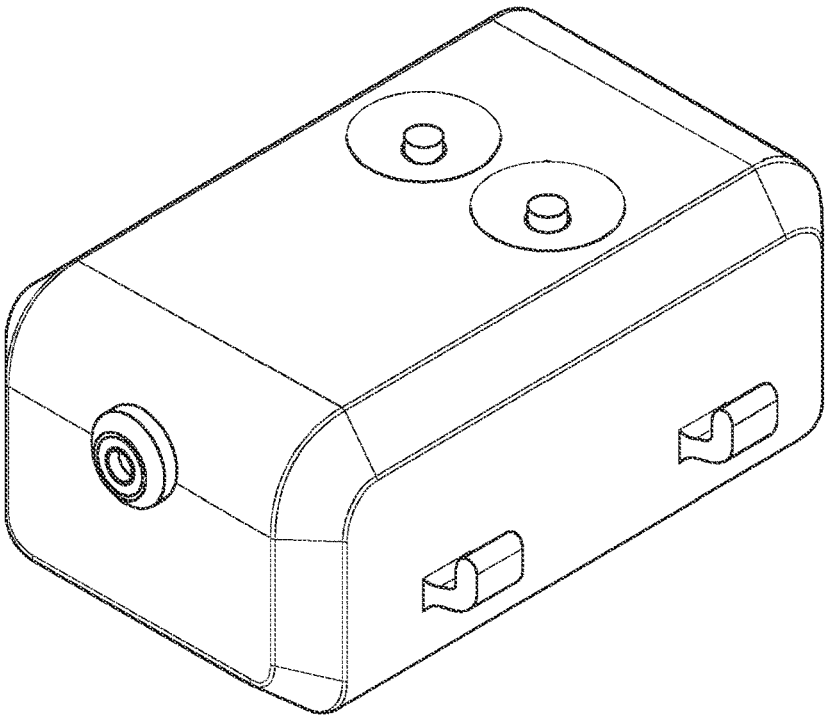
FIG. 5 shows the SMS remote housing

There are three modules that make up the sensing system: The SMS Sensor, SMS Remote and SMS monitor software, that operates on an external computer. In one embodiment of the invention, a sensor circuit is contained within a sensor housing that comprising the SMS Sensor. This device may be mounted on the wind instrument in the region of the mouthpiece. The sensor housing has a pipe emanating from it that leads to the mouthpiece of the instrument. The sensor housing is comprised of an air pressure sensor. FIG. 1 and FIG. 2 show side views of the mouthpiece of a reed musical instrument, that is, clarinet or saxophone etc. The thin end on the left is inserted into the players mouth. The right side begins he throat of the instrument. The reed is 104/204. 105/205 is the prior art metal strap that holds reed to the bottom of the mouthpiece. 106/206 shows the beginning of the throat of the instrument. Item 102/202 is a hollow flexible tube that feeds into the air pressure sensor device 101/201. There are two embodiments of the other end of the tube: In FIG. 2, 207 shows the tube going under the foam layer 203 and going into hollow section of the mouth piece along is surface. In FIG. 1, 107 shows the tube extending under the foam layer 103 all the way to the end such that the tube end would be in the musician's mouth region.

In the preferred embodiment, the SMS Sensor (101/201) is comprised of a solid state electronic device that converts air pressure into a signal, preferably a digital data signal, although in some embodiments, an analog output may be used. As the air pressure in the pipe changes, the air pressure at the sensor device comprising SMS Sensor (101) causes the digital values output from the sensor device to change. In one embodiment, a sensor is used that provides an absolute pressure measurement in the range of 10-1300 milli-bars. The SMS Sensor module is comprised of the sensor device that operatively connected to a microcontroller comprised of a central processing unit (CPU), a computer memory and a radio frequency data transceiver. The sensor device, memory and RF transceiver are addressable by the CPU using typical computer microprocessor design techniques such that the CPU can read and write data from these components in accordance with a processes running on the CPU as a program.

As the musician plays, the CPU in the SMS Sensor can poll the air pressure sensor to read and thereby capture and update data representing the air pressure in the musician's mouth region in near-real time. In addition, the SMS Sensor module can transmit this data stream to the external computer by writing the air pressure data into the communications unit. The communications unit can then transmit this data to the external computer. As an alternative embodiment, the process that reads the sensor may be interrupt driven rather than polled. In either case, the air pressure value is periodically read from the device and transmitted to the SMS Monitor processes running on an external computer.

In another embodiment, the position of the musical instrument itself can be detected. In this embodiment, the sensor housing contains a device that can detect the orientation of the musical instrument relative to the earth's magnetic field. In the preferred embodiment, the sensor housing contains a device that can detect its angular position relative to the earth's magnetic field using a magnetometer. The detection may be the relative angle between a fixed axis of the sensor and the local field lies of the earth's magnetic field. This information is accessible by the CPU by reading addressable registers where the current device orientation relative to the earth's magnetic field is presented. As the musician plays and moves around, that orientation data changes. The orientation data is typically encoding orientation along the horizontal plane. The CPU reads this data from the sensor registers and stores them in the computer memory. In addition, the CPU can write the data to the communications unit, which can then transmit the information to the external computer.

In another embodiment, the sensor housing comprising the SMS Sensor module (101) contains a device that can detect the elevation angle of the musical instrument. In the preferred embodiment, the sensor housing contains a device that can detect its angular position relative to the earth's gravitational field. The detection is the relative angle between a fixed axis of the sensor and the center of the earth's gravitational field, typically the center of the earth. This information is accessible by the CPU by reading addressable registers where the current device elevation is presented. As the musician plays and moves the instrument up and down, the elevation data changes. The elevation data is typically encoding elevation in a vertical plane, perpendicular to the horizontal plane. The CPU reads this data from the sensor registers and stores them in the computer memory. In addition, the CPU can write the data to the communications unit, which can then transmit the information to the external computer.

In yet another embodiment, an accelerometer sensor may be used within the SMS Sensor module (101). In this embodiment, the data generated by the accelerometer sensor represents the motion of the instrument and its direction relative the sensor axis. Some accelerometers output data representing movement in two dimensions and some in three. In the preferred embodiment, the accelerometer operates in three dimensions. Using this embodiment, an accelerometer sensor data stream may be used in place of an orientation sensor and elevation sensor. The accelerometer data stream may be utilized by the SMS Monitor to calculate the location of the instrument based on a series of motions starting at a calibration start point. The accelerometer data stream may represent a series of motion vectors, each vector representing a time slice. By numerical integration, a position vector may be calculated from a series of acceleration vectors. The resulting position vector will be a relative vector to the initialization position. The sum of both vectors will then be the absolute position and orientation of the instrument.

In yet another embodiment, the sensor in the SMS Sensor module may include a gyroscope sensor. This sensor can measure absolute direction orientation of the musical instrument relative to the gyroscope's nominal position. In this embodiment, the sensor data stream will provide data representing the orientation of the musical instrument. In yet another embodiment, the air pressure sensor, magnetic field sensor, gravitational field sensor and gyroscope sensor may all comprise the SMS Sensor, and further may all be part of the same solid state device housed within the SMS Sensor and addressed by the CPU.

In the preferred embodiment, the processed data of the sensors are scaled and offset so that for whatever maximum and minimum set positions or elevations, the range of output from the processor is from and including zero to one, or from minus one to plus one. This then avoids the problem that as the musician deals with specific contingencies from one venue to the next that the downstream uses of the data as it applies to audio signal processing or venue environment controls can remain the same.

Normalization involves calculating a linear function such that the incoming data is scaled so that the maximum incoming data value is converted to a predetermined maximum in the output range, and the minimum incoming data is converted to a predetermined minimum in the output range. The offset is a value added to the input data to accomplish the same purpose. The normalization function can be considered as:

Output value=(Input value plus Offset value) times Scaling Factor

Or

Output value=Offset value plus (Input value times Scaling Factor)

In some embodiments, the Scaling Factor itself may be a function of the input, in order to introduce logarithmic or exponential scaling:

Output value=Offset value plus (Scaling Factor times log(input value))

Or

Output value=Offset value plus (Scaling Factor times exp(exponent, input value))

The data collected by the SMS Sensor module is transmitted to the SMS Monitor module. This can be accomplished preferably using a Bluetooth™ network or any other data network. The data may include some or all of the sensor data described above. For example, use of an accelerometer and gyroscope may be sufficient. Conversely, use of a magnetometer and gravitational sensor may be sufficient. The SMS Monitor module processes the incoming data from the SMS Sensor module in order to prepare it for downstream use. In the case of the air pressure, the computer operates a process that normalizes the data, so that the range of input data from the musician is either scaled up or scaled down by a predetermined amount such that the output of the scaling has a range of values that are usable by downstream uses, described further below. In the preferred embodiment, the air pressure values are scaled to be between and including zero to ones. Further, an offset may be applied so that the ambient air pressure is set to be zero. This is applied to the data as it is flowing because the processed data output is then relayed through computer inter-process communication techniques to audio processing computer programs or performance environment controlling software, as further described below.

Similarly, the orientation and elevation data is preprocessed by the external computer comprising the SMS Monitor module by scaling in the same way. In the preferred embodiment, pre-processing is performed by the computer calculating a linear mathematical function on the incoming data with a pre-determined linear coefficient. In other embodiments, other mathematical functions may be used, for example, a logarithmic function that also has a linear coefficient.

In the case of orientation, the external computer first calibrates itself by setting a nominal orientation for the instrument. For example, the nominal orientation could be set for when the musician's instrument is pointing out from the stage, that is, the longitudinal axis of the instrument is perpendicular to the edge of the stage, or perpendicular to the rows of seating in a venue that a performance is occurring. This may represent the actual compass orientation of the instrument relative the earth's magnetic field. As the computer receives orientation values from the communication unit of the sensor housing, these actual values, which may represent compass angular values are then converted into angular values relative to the set nominal position, both positive and negative.

In another embodiment, the nominal position could be set to a left maximum or right maximum and the conversion to angular values relative to those nominal positions. In addition, the external computer can set a maximum stage left position and maximum stage right position. Then, the incoming actual compass values can be scaled so that for different venues, where motion of the musician may be constrained, the downstream uses of the data retain the same range of effect while using more constrained motion. In other words, the range of output of the scaling is the same, and the coefficient of the scaling is determined from the set maximum left and right positions. The relative orientation output is then relayed through computer inter-process communication techniques to audio processing computer programs or performance environment controlling software, as further described below.

The elevation sensor data may be scaled and calibrated similarly. The external computer can set a minimum elevation, for example when the musician holds the instrument pointing down at the lowest point the musician cares to select, and then the maximum elevation that the musician wants to point up. The external computer process can then scale the elevation data so that the output range is at its maximum and minimum using those to set positions.

The SMS Monitor processes can also manipulate the sensor data as follows:

Sampling rate multiplication by extrapolating continuous data. If the downstream applications require more granular measurements over the time axis, the SMS Monitor can extrapolate between two known measurements to estimate a measurement that is prior to the next polled data point. For example, of position is polled at zero and 10 milliseconds, but the downstream application wants values every 5 milliseconds, then the two measurements can be used to calculate a slope, and then the second measurement plus ½ times the slope will be the estimated value at 15 milliseconds.

Data priority hierarchy. If the downstream application has different priority needs for the data feeds, for example, audio processing being more important to be real time than stage lighting, then the data feeds from the sensors are processed and transmitted downstream with that priority.

Gesture detection. The data feeds from orientation, elevation and the accelerometer may be used to extract a general feature of movement that is recognizable by the computer. For example, the data may represent a motion of down and up on the left side, followed by a swing to the right. While every rendition of the gesture may result in data that is numerically different, the SMS Monitor can apply pattern recognition algorithms to detect a condition that such a gesture has occurred because the numerical data representing the measured gesture is sufficiently close to a predetermined data pattern. This pattern recognition result can be converted by the computer process into a data message representing a command to be processed by the downstream system.

The SMS Monitor operating on the external computer presents the user a graphical user interface (GUI) on a display screen in order to permit the user to input by means of touch screen or other actuation device connected to the computer and select various parameters of operation. For example, the GUI may display a slider bar on a touchscreen attached to the computer that permits the user to select, by moving the bar on the touch screen, bar position and thereby select the scaling factor for the normalization process. Furthermore, the various scaling factors for the various sensors may be saved in a file on the SMS Monitor to permit these parameters to be recalled.

Figure 6:
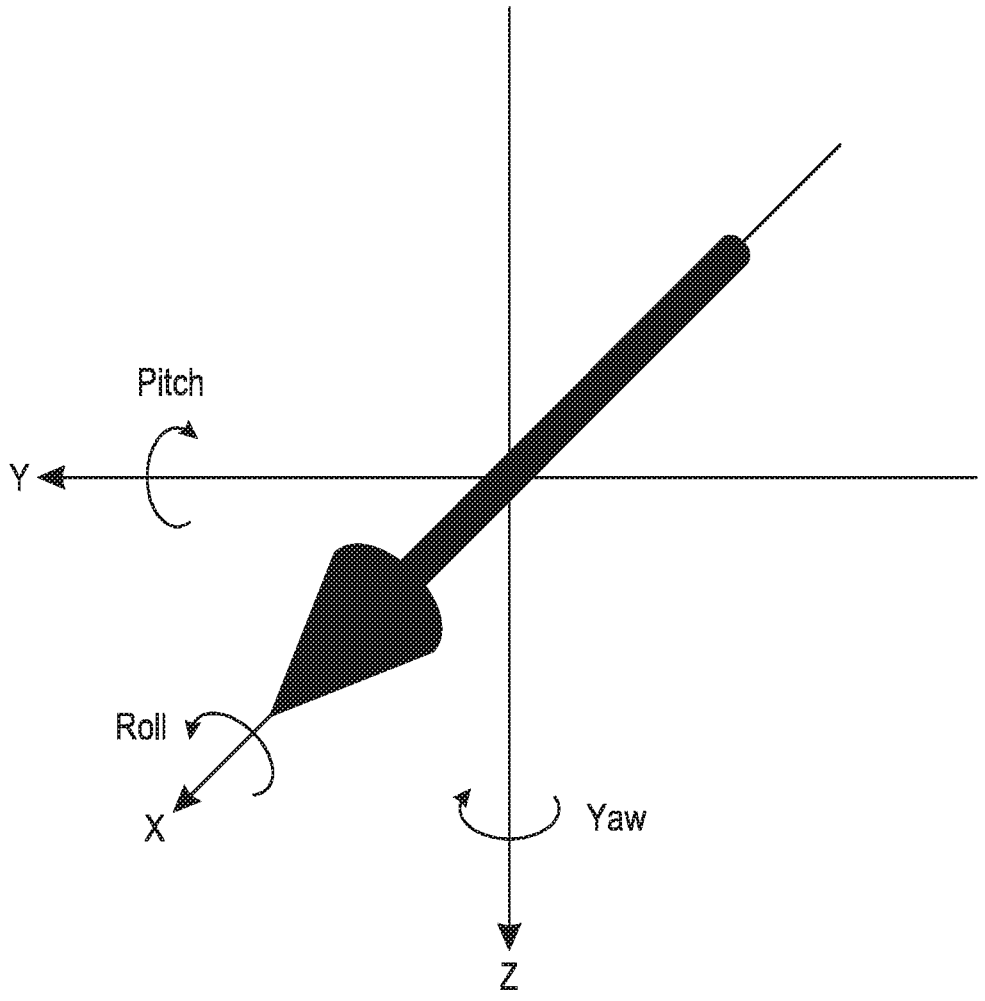
FIG. 6 shows a representation of an "airplane" style display showing the detected orientation of the musical instrument.
Figure 7:
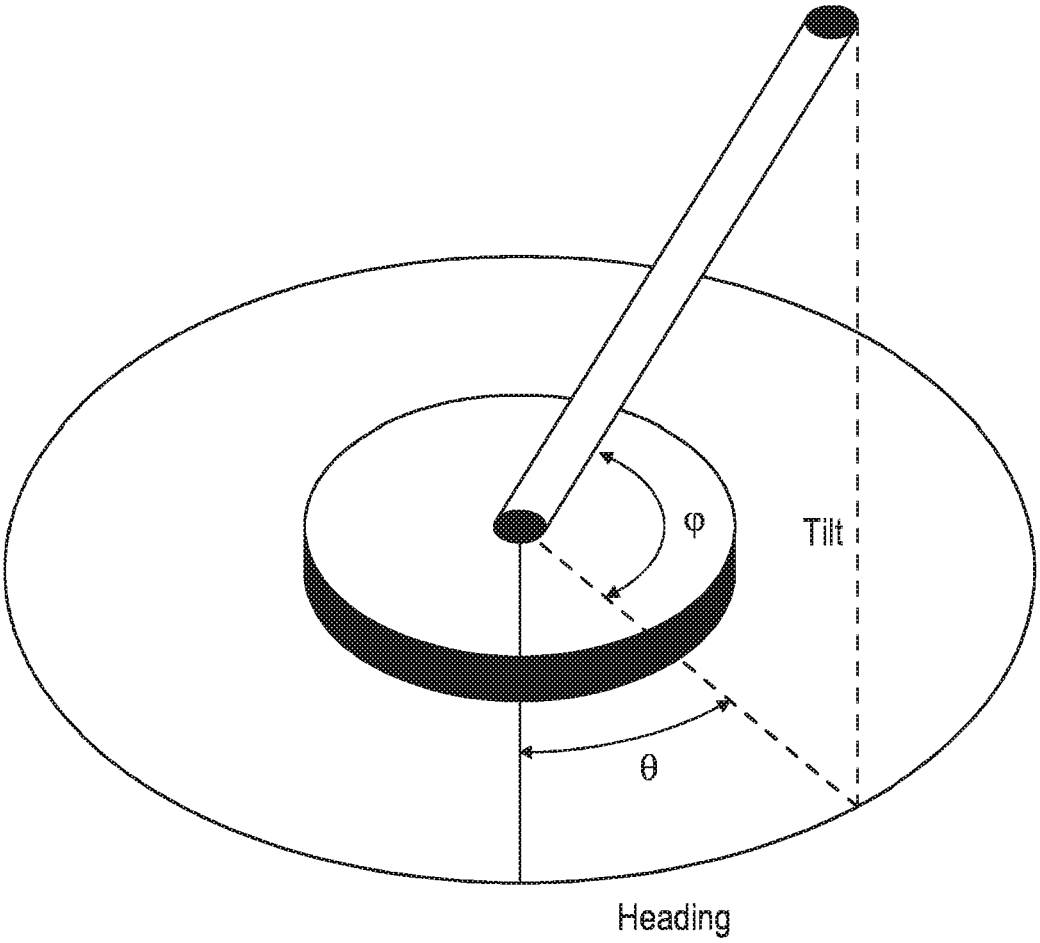
FIG. 7 shows a representation of a "joystick" style display showing the detected orientation of the musical instrument.

In one embodiment, the SMS Monitor presents an apparent 3 dimensional graphic on the display screen showing the apparent position of the musical instrument based on the sensor data as described above. In one embodiment, the display is presented as a "joystick", (FIG. 7) where the rendering is a view of the instrument away from a geometric origin. As the orientation of the instrument is detected, the SMS Monitor uses the received positioning data to generate graphical primitives with geometric values that are calculated so that when displayed, shows the apparent orientation of the instrument in a predetermined orientation with respect to the plane of perception and orientation. Another embodiment is an "airplane" display, (FIG. 6) where the position of the instrument is shown as if looking down the axis of the instrument. In either case, This display can show the apparent orientation of the instrument as determined by the SMS Monitor, in order that scaling factors be selected. The SMS Monitor can select between displaying the raw position of the instrument and the normalized and offset position based on a selection by the user of a selection actuation on the GUI. Mapping parameters that adjust how the actual position of the instrument is applied to generate control data output can be also applied to adjust these graphical representations. For example, a scaling down of angular data may be used such that when the instrument is swept from +45 degrees to −45 degrees across a crowded stage, the display shows the instrument swinging side to side more widely, and therefore the control data being transmitted downstream encoding a narrow sweep of the instrument's position into a complete sweep for controlling the sound processing equipment.

Most importantly, the SMS Monitor permits the user to select output channels for the data, where the output channels provide the sensor data for controlling downstream audio equipment or stage show effects. In one embodiment, there is an audio to electrical signal converter, typically a microphone, (303) into which the instrument sound itself is converted to electrical signals. These signals can be converted to digital values representing the sound of the instrument. That digital data stream may be processed by a computer program operating various digital audio signal processing techniques, either in a stand-alone audio processing device (307) or within the external computer (304). The data stream may also be parsed and reformatted so that the data presentation is compatible with the downstream equipment communication and data processing protocols, that is, the downstream equipment receiving the data is detecting the data in a manner it expects so that the equipment accurately obtains usable control information. In embodiment, presented as a non-exhaustive example, the digital audio processing may include volume or level, audio frequency equalization, or the amount of an effect applied to the signal.

In another non exhaustive example, it may be echo effects applied to the digital audio signal. As is known in the art, the echo effects may be adjusted while the musician plays, for example, the feedback on the echo, which determines the number of audible echo responses, or the level of the effect as compared to the input signal. The musician can control these effects by means of the data transmitted from the SMS Monitor (305). In one embodiment non exhaustive example, the instrument air pressure data sensed by the SMS Sensor (301) may be used as an input into the digital audio processor (307) to set the feedback of the echo, while the elevation of the instrument may be used to set the level of the echo effect. In this example, the musician may perform a melodic motif, but move the instrument to a position where as the motif reaches a crescendo, the amount of echo effect is increased. The output of the audio processor (307) is delivered to a public address or "PA" system (308) in order that the audience hear it. The audio processor (307) may be a component of a larger sound mixing console or an external device connected to a sound mixing console, or a digital audio workstation whose output drives the PA (308), or even delivers audio data to a recording medium for purposes of creating a constituent track of a sound recording.

Given the many possibilities of what digital audio effects are used and which of the sensor data parameters drive which audio effect inputs, the SMS Monitor can route the sensor data by packetizing the data so that a given sensor data output is associated with one or more downstream audio effect parameters. That is, the SMS Monitor (305) may generate a data file (314) stored on a disk comprising the external computer (304) representing predetermined routing matrix, that associates a given sensor data stream with (301) a downstream by way of a network connection (306) audio processing parameter (307). To accomplish this, the external computer (304) may include a routing module that presents to the user a GUI that shows the available sensor data streams and the available downstream audio processing parameter inputs (307). The routing module can then receive from the user input selections that are used to determine or map which sensor data streams go to which downstream audio processing parameters. This routing or mapping matrix may be a data file that can be stored on the computer (314) and recalled by the user. The SMS Monitor (305) then parses the normalized data stream and prepares it for downstream use by the selected audio processing equipment or stage effect controllers.

In a similar manner, the sensor data may be routed to non-audio effects. For example, in an other embodiment, a musician performing on a stage may have stage lights of multiple or variable colors (313). In this embodiment, the SMS Monitor mapping function (314) may map a particular sensor to an electronic device or system that controls the color of the stage lighting (310). As a non-exhaustive example, there may be three lights on the stage, red, green and blue. (313) Each of the lights are powered through a corresponding variable power supply (312), whose outputs determines the amount of light from corresponding light. The three power supplies (312), preferably connected to a typical alternating current power source (311), may be controlled by a light controller module (310) that receives digital data (309) from the SMS Monitor (305) and then adjusts the power supplies in accordance with the digital data stream. Using this system, the musician may set the lighting to be blue, when the instrument is pointed stage left, all three (and therefore white) in the middle, and red when the instrument is pointed stage right. As the sensor data is received by SMS Monitor (305), the routing or mapping module (315) can send the positional data to the lighting controller module (310), which then adjusts the intensity of each light based on the input data stream.

As an alternative embodiment, the process that reads the sensors operating on the SMS Sensor module (301) may be interrupt driven rather than polled. In either case, the air pressure values, orientation values and elevation values are periodically read from the sensor devices. As a result of the foregoing processes, the external computer running the SMS Monitor, (304, 305) obtains data in near real time encoding (i) the air pressure of the musician's mouth region, (i) the orientation of the instrument in the horizontal plane and (iii) elevation of the instrument in a vertical plane perpendicular to the horizontal plane. The external computer running the SMS Monitor (305) takes the received data arriving from the transceiver (316) and pre-processes it. Button pushing at the SMS Remote (302) can cause interruption, causing the system to check which mapping matrix (314) is being used by the routing module (315) or whether the musician is selecting a calibration of the sensors and SMS Monitor to occur as described above. In another embodiment, each sensor can be polled at an independent adjustable frequency. In yet another embodiment, the sensor data may be transmitted from the sensor module in the form of Euler angles, quaternions, raw acceleration, linear acceleration, gravity, or temperature.

In one embodiment, there is a SMS Remote module, (302) which is a device that is attached to the instrument that is operatively connected to the external computer (304) running the SMS Monitor module (305) by means of either the SMS Sensor module (301) or the SMS Monitor directly through its wireless transceiver (316), either case preferably via a wireless communication protocol. A wire may be used to connect the SMS Remote module unit to the SMS Sensor module unit or they may be connected wirelessly. The SMS Remote unit (301) may have one or more electric switches on it that may be actuated by the musician. In one embodiment, a button press is relayed to the sensor unit (301) and then the external computer (304) running the SMS Monitor module (305). In this embodiment, the button press informs the SMS Monitor process (305) that the musician is selecting a calibration mode for the system. In one embodiment, there is one button, and the musician cycles through a series of calibrations, pressing the button each time. For example, positioning for the nominal orientation and minimum elevation, then pressing the button, then positioning for maximum elevation, pressing the button, then maximum left, and pressing the button, and then maximum right and pressing the button. This may be followed by not blowing into the instrument and pressing the button in order to calibrate the ambient air pressure for further data processing as described above. In other embodiments, there may be two buttons, one for orientation, one for air pressure calibration, or three buttons for each of the three sensors. In addition, the buttons may be programmed to turn the entire system on and off. Or, with two buttons, one may turn on and off the use of the sensor data as it applies to the downstream audio processing and the other to turn on and off use of the sensor data as it applies to the performance environment controls.

In one embodiment, the button controllers in the remote device (302) may be used to transmit control data to the SMS Monitor (305) that permits the musician, while on stage and performing, to select which mapping or routing matrix to be used (314). In this embodiment, the button selection on the SMS Remote (302) is detected and transmitted to the SMS Monitor (305). The SMS Monitor (305) can then select which mapping function (314) to use based on the selection from the button. In one embodiment, there may be two mapping functions, and the two buttons select between the two. In another, a single button press can cause the SMS Monitor (305) to cycle to the next matrix mapping, to a last mapping before cycling to a predetermined first mapping matrix. This may be used when the performer prepares to perform the next piece in the repertoire.

In another embodiment, the buttons on the SMS Remote (302) or buttons on the SMS Sensor (301) can be used to select the following functions:

Go to default state. (this is used if there is a panic situation where the entire system is in an error state during a performance, as determined by the musician.)

Initiate Calibration.

System Off.

System On.

The microcontroller in the SMS Sensor (301) is comprised of CPU, main memory, read-only memory and a radio frequency data transceiver, for example Bluetooth™. The read only computer memory is comprised of data that when used as program instructions operating on the CPU, makes the microcontroller operate a process, which includes reading data from the sensor devices and storing that data in the computer memory or writing the sensor data into the data transceiver for transmission to the external computer. The micro-controller also is comprised of a data transceiver unit. This device is addressable by the CPU, both to read data from it and to write data into the device. The communications unit is further comprised of a radio transmitter and receiver. In the preferred embodiment, the radio frequency communication may comply with the Bluetooth™ standard. Similarly, at the process control level, the communications unit can operate a protocol that permits the micro-controller to communicate with external devices, including an external computer, for example, a personal computer. Similarly, the CPU can read the state of buttons on the SMS remote by means of reading data from the transceiver. The SMS Remote is connected to the SMS Sensor by having its own radio frequency data transceiver. By means of inter-process communication, the SMS Monitor can control the behavior of the SMS Sensor unit, and at the same time, the SMS Sensor unit can control the SMS Monitor, while providing it the sensor data stream. The SMS Remote (302) can control the SMS Monitor by having its button data, transmitted to the SMS Sensor and then further transmitted to the SMS Monitor, or, having a direct communication between the SMS Remote and the SMS Monitor utilizing the Bluetooth™ network.

The external computer (304) may be a standard available personal computer, comprised of a central processing unit, main memory, a mass data storage device like a disk drive or solid state drive, a radio frequency data transceiver, like a Bluetooth™ component that provides data to the CPU or transmits data to other devices, a display screen and an input device, either a keyboard, mouse or touch screen input device. The external computer may be comprised of main memory containing program code that when executed by the CPU performs processes described above. The main memory can store the mapping matrices when in use. They may be stored on the mass storage device and then loaded into main memory. They may be generated or edited while in main memory, and the revised versions stored on the mass data storage device. The digital audio processing may occur on the same external computer or on another computer that receives data over a network from the external computer. The lighting and other stage effect controllers (310) may be processes operating on the external computer or on another computer that receives data over a network from the external computer.

In one embodiment, all of the sensors are embodied in one case mounted on the instrument. In addition, the controlling buttons are mounted on a case on the instrument as well. In another embodiment, the connection of data communication between the modules is accomplished using Bluetooth LE™. In one embodiment, the sensor servicing software code operating on the device is interrupt driven. In some cases the pressure sensor is polled while the remaining sensors are interrupt driven. The orientation of the device may be sensed by using a magnetometer. Further, the system is adapted to detect a sequence of movements that permit the musician, while playing to control the system using gesture recognition. Each sensor in the SMS Sensor case may have its own individual data stream to the SMS Monitor. Each may have its own update rate. If the rate of data on the monitor side is greater than its need in the firmware recalculation, then preprocessing may be applied to interpolate and thereby generate interpolated data points for the downstream controllers.

The pre-processing features are meant to be a part of what currently takes place in the monitor. After the data has been received and parsed, it can be calibrated along provided min/max and offset values; scaled within the −1 to 1 range; filtered against noise or unwanted incidences; and tested against recorded gesture primitives. Thus, the monitor applications remains an optional monitoring tool and reduces on the personal computer both the CPU needs and display space, that can be assigned to other tasks.

The latency control accesses at least two parameters: the Bluetooth connection interval that is controlled at receiver (master) side and a priority control to ensure that the data stream is not delayed by some higher priority task. In addition, it is easier to rely on a given Bluetooth version (currently 4.2, eventually upgrading to 5.0), with its own hardware rather than depending on computer age and operating systems (for example, Apple works with Bluetooth 4.0 to 4.2, pre-2011 computers are not Low Energy compatible).

The data stream follows the following sequence:

1. If new data exists, it is acquired at the next connection anchor (which determines the connection interval and can be optimized);

2. data is parsed depending on its origin (which sensor, but also which device if several are connected)

3. parsed data is pre processed—if needed—that is, it is calibrated, scaled and filtered 4. pre-processed data is formatted and sent via either an UDP or an USB connection to a computer 5. formatted data can be monitored on the computer or used as-is with any software application that takes the formatted data as input for controlling its operation.

What is claimed:

1. A system for controlling in real-time at least one stage effect equipment comprising:

A sensor module comprised of at least one sensor that generates at least one sensor detection of a corresponding at least one physical condition of a musical instrument while it is being played, such at least one physical condition including at least one of: mouth pressure, instrument axial orientation, instrument location relative to a predetermined location on the stage, said sensor module comprised of an electronic circuit configured to convert the at least one sensor detection into a substantially real-time corresponding to at least one sensor data stream comprised of data representing the corresponding at least one sensor detection;

A monitor module that receives the at least one sensor data stream, said monitor module further configured to transform the received at least one sensor data stream into a corresponding at least one output data stream that further corresponds to and is compatible with the at least one stage effect equipment;

where the at least one stage effect equipment is configured to receive the corresponding at least one output data stream and modify the functionality of the at least one stage effect equipment substantially in real time in dependence on the corresponding received at least one output data stream.

2. The system of claim 1 where the at least one sensor comprising the sensor module is at least one of an: accelerometer, air pressure sensor, magnetometer, gyroscope.

3. The system of claim 1 where one of the at least one stage effect equipment is comprised of a light, and the functionality that is modified is the brightness of the light.

4. The system of claim 1 where one of the at least one stage effect equipment is comprised of a light, and the functionality that is modified is a color of the light.

5. The system of claim 1 where one of the at least one stage effect equipment is comprised of a light, and the functionality that is modified is an axial direction of the light.

6. The system of claim 1 where the at least one stage effect equipment is comprised of an audio signal processor and the functionality that is modified is at least one predetermined audio effect that is applied to a corresponding at least one audio signal passing through the audio signal processor.

7. The system of claim 6 where the at least one predetermined audio effect is an echo effect.

8. The system of claim 1 where the monitor module is configured to transform the at least one received sensor data stream so that the at least one output data stream is comprised of at least one data packet, each data packet comprised of at least one corresponding data representing which of the at least one stage equipment the data packet is to be routed to.

9. The system of claim 1 where the monitor module is further configured to transform the received at least one sensor data stream to minimize noise in the at least one sensor data stream.

10. The system of claim 1 where the monitor module is further configured to transform the at least one received sensor data stream by mapping an at least one first predetermined value range of the corresponding at least one received sensor data stream to an at least one corresponding second predetermined value range for the corresponding at least one output data stream.

11. The system of claim 10 where the mapping uses a mathematical function that is at least one of: linear transformation, exponential transformation, logarithmic transformation.

12. The system of claim 10 where the monitor module is further configured to receive a control signal that instructs the monitor module to change the mapping in response to the control signal.

13. The system of claim 10 further configured to have an operational logic state and a calibration logic state, and is configured to receive input data generated by the sensor module that specifies at least one predetermined mapping for the monitor module when in the calibration logic state and to perform the specified mapping function when in the operational logic state.

14. The system of claim 13 further comprising at least one switch device that when actuated causes the sensor module to generate a control signal that sets the system into the calibration logic state.

15. The system of claim 13 further comprised of a computer comprising a display device, said display device configured to display the apparent axial position of the instrument in real time as a three dimensional graphic.

16. The system of claim 15 where the three dimensional graphic is in the form of a joystick diagram.

17. The system of claim 15 where the three dimensional graphic is in the form of an airplane diagram.

18. The system of claim 1 where the monitor module is further configured to receive a control signal from the sensor module that represents a panic logic state and in dependence on the control signal, transmit into the at least one output data streams a corresponding at least one command to the stage equipment to switch to a default panic state.

19. The system of claim 18 where the panic logic state is that the amount of audio effect is reduced or not applied at all.

* * * * *